United States Patent [19]

Hullinger

[11] 4,267,852

[45] May 19, 1981

[54] PROCESS FOR ENHANCING AND STRENGTHENING THE GROWTH OF NAILS

[76] Inventor: Judith E. Hullinger, 6605 E. State Blvd., Suite No. 7, Fort Wayne, Ind. 46815

[21] Appl. No.: 75,882

[22] Filed: Sep. 17, 1979

[51] Int. Cl.[3] ..... A45D 29/00

[52] U.S. Cl. ..... 132/73

[58] Field of Search ..... 132/73; 424/61

[56] References Cited

U.S. PATENT DOCUMENTS

| | | | |
|---|---|---|---|
| 1,370,753 | 3/1921 | Loring | 132/76.4 |
| 2,073,867 | 3/1937 | Feigenbaum | 132/73 |
| 2,195,971 | 4/1940 | Peter et al. | 424/61 |
| 2,209,408 | 7/1940 | Litt | 132/73 |
| 2,346,234 | 4/1944 | Reynolds | 132/73.5 X |
| 2,383,990 | 9/1945 | Quisling | 424/61 |
| 3,257,280 | 6/1966 | Richter | 424/61 |
| 3,483,289 | 12/1969 | Michaelson | 424/61 |
| 4,184,499 | 1/1980 | Seidler | 132/75.6 |

FOREIGN PATENT DOCUMENTS

| | | | |
|---|---|---|---|
| 1267528 | 9/1959 | France | 424/61 |

OTHER PUBLICATIONS

Cosmetics-Sagarin-1957 pp. 489 and 684 Relied upon.

*Primary Examiner*—G. E. McNeill

*Attorney, Agent, or Firm*—Gust, Irish, Jeffers & Hoffman

[57] ABSTRACT

The method and compositions for enhancing the growth and strength of fingernails and toenails.

9 Claims, No Drawings

PROCESS FOR ENHANCING AND STRENGTHENING THE GROWTH OF NAILS

BACKGROUND OF THE INVENTION

This invention relates to new and improved methods and compositions for enhancing the growth and strength of fingernails and toenails.

Heretofore, difficulty has been encountered in enhancing the growth and strength of fingernails and toenails. These difficulties appear to reside primarily in protein and vitamin deficiencies in the fingernails and toenails, resulting in unsightly appearing nails, chipping and breaking of the nails.

For example, the normal treatment of nails with a protective colored or clear polish has not resulted in the elimination of chipping, breaking or, particularly, the strengthening of the nails.

Moreover, prior art processes for strengthening fingernails, as well as the products or compositions used for such strengthening, did not take into consideration the protection of the nails during growth of the nails over time.

In general, the prior art treatments involved filing and buffing of the nails to condition them for the reception of polishes and then sealers and/or hardeners before the polish is applied. A false fingernail, i.e. tips, may be first applied, which is then shaped to the finger of the patron and polished and sealed in the conventional manner. It has been observed, however, the false acrylic nails tend to deteriorate the fingernails, i.e., do not let the nails "breathe".

These prior art treatments, however, did not take into consideration the fact that the nails were part of the human anatomy and could be strengthened by the application of protein to the nails.

Furthermore, the known prior art treatments did not involve any attempt for the direct physical penetration of the nails with protein base materials.

SUMMARY OF THE INVENTION

These problems and disadvantages of the prior art, among others, are substantially overcome with the present invention by the application of protein materials directly to the nails themselves, which protein materials penetrate into the nails. Protein containing materials are first applied directly to the nails with heat. A silicone cream, preferably including a protein base material, is then applied to the nails and buffed therein to provide moisture and protein into each nail and also providing a protective coating of silicone on the coated nails, as well as to give the nails a shine or polish. Subsequently, a liquid composition, including fibers, such as nylon fibers, is applied to the coated nails to give additional strength and for protection of the entire nail from chipping, etc. Next, a sealer and hardener may be applied to the nail to seal the fibered coating and, as a preparation for adhering nail polish to the nails. The nails are then coated with a cream nail polish and, after the nail polish dries, a top coating of clear polish is applied.

It is, therefore, an object of the present invention to provide new and improved methods and compositions for strengthening fingernails and toenails.

Another object of the present invention is to provide new and improved methods and compositions for strengthening fingernails and toenails as they grow.

Due to the method by which these products are applied, results are obtained with the polish staying on without chipping for a much longer period of time shown in the prior art, thus increasing the protection of the nails and decreasing the time involved of subsequently caring for the nails by each individual.

Still another object of the present invention is to provide new and improved methods for increasing the protein content of fingernails and toenails and adding moisture thereto.

A further object of the present invention is to provide new and improved methods for protecting fingernails and toenails from chipping and breaking.

A still further object of the present invention is to provide new and improved methods for protecting fingernails and toenails from the ambient.

These and other objects, features and advantages of the present invention will become readily apparent to one skilled in the art from a careful consideration of the following detailed description.

DESCRIPTION OF A PREFERRED EMBODIMENT

In accordance with the present invention, the patron's hands, at the first session, are cleaned and the nails sterilized in a conventional alcohol solution.

Then, any polish existing on the fingernails is removed.

The nails are then cleaned in a germicide solution, such as the vitamin germicide known as "Soak No. 10", sold under the trade name by Beatrice Kay Cosmetics of Beverly Hills, Calif.

The nails are then shaped to the hand by filing thereof.

Thereafter, each hand is placed individually in a vitamin oil solution which is maintained at a temperature above room temperature. A suitable vitamin oil material is that sold by Revlon, Inc. of New York, N.Y., under the trademark "Lactol No. 1069". "Lactol" is an emulsified oil which enhances replacement of natural oils and moisture to counteract dry brittle nails and rough cuticles. This solution is massaged into the fingers and cuticles to encourage circulation in the nail beds and cuticles and penetration of the cuticles with the vitamins.

The cuticles are then pushed back in the normal manner and all hangnails and remaining loose cuticles are clipped.

The nails are then again cleaned in the aforementioned vitamin germicide solution and dried.

In order to add protein and moisture directly to the nails, an emulsion composition of the present invention comprising natural henna, a proteinaceous product consisting of an aqueous solution of collagen polypeptides and amino acids are mixed with hot water in an amount sufficient to make a jelly-like emulsion and applied directly to the nails. A proteinaceous product found useful in this mixture is the P.P.T. "S-77" hair reconditioner sold under that trademark by Redken Laboratories, Inc. of Canoga Park, Calif. It has been found that the protein composition acts effectively in accordance with this invention if the ingredients are in proportion by volume of about 25% neutral henna, about 25% of the aqueous solution of collagen polypeptides and amino acids and about 50% hot water. In any event, the mixture consistency should be tacky or jelly like. It has also been found that for treatment of one patron's hands, one-fourth teaspoon of neutral henna, one-fourth teaspoon of the proteinaceous product solution and one-half teaspoon of hot water will suffice. The tacky, jelly-like emulsion is then applied liberally to the nails directly. The emulsion is permitted to remain on the nails for a period of approximately 2 to 3 minutes while being dried, preferably under an incandescent heat lamp. It appears the heat assists the protein containing emulsion to penetrate the nails and also add moisture to the nails.

The nails are then rinsed and cleaned again in a vitamin-mineral germicide solution, such as that indicated above.

After the nails have been cleaned, they are dried in preparation for the application of a second coating. This coating is basically a silicone cream which is applied to the nails with a spatula. Preferably, the silicone cream also contains proteinaceous substances. A suitable protein silicone cream useable for the second coating is that sold under the trademark "RE NEW" by Amazing Corp. of Groves, Tex.

After the silicone cream has been applied to the nails, the nails are then subjected to heat, for example, by being exposed to an incandescent heat lamp for 1 to 2 minutes. After the nails dry, they are then buffed with a chamois, preferably in one direction. It appears that this second coating also penetrates the nails and applies protein and moisture directly into the nails during heating and buffing of the nails. It has also been observed that the silicone cream tends to adhere any splitting layers of the nail, thus, making the nail stronger, as well as applying a protective coating of silicone on the nails. The silicone layer gives a shine that remains on the nails even after many coats of polish have been removed therefrom by polish remover.

After the nails have been buffed, the cuticles may be cleaned, again, in the above-mentioned germicide solution.

If it is observed that there is any splitting of the nails at this point, the nails may be mended with tips and/or transparent mending strips and adhered to the nails. Of course, the nails would then be buffed and sufficient glue applied to assure adherence of the tips or strips to the nails.

After the nails are dried, they are now ready for a third coating of a liquid containing discrete microscopic fibers, such as the nylonized base coat lacquer sold under the trademark "Mend'R" by the House of Barrie of Fifth Ave., New York, N.Y.

This coating of liquid fibers is applied to the nails on the top and underneath, where possible. The nails are then permitted to dry at room temperature. The coating of liquid containing the fibers is employed to add strength to the nails.

After the nails have dried, a conventional sealer and hardener is applied to not only the nail tops, but also underneath the nails to cure and seal the fiber coat and help the nail polish, when subsequently applied, adhere to the nails. The nails are then, once again, permitted to dry. A sealer and hardener found useful in the practice of the present invention is that sold under the trademark "Perfect Nail" by Sykes Laboratory, Inc. of Miami, Fla. It has been observed that continued use of sealers and hardeners, in general, tend to cause brittleness, chipping and cracking of the nails. However, this phenomenon does not occur with the use of sealers and hardeners in the practice of the present invention.

The nails are now ready for the application of a coating of cream nail polish. It has been found that cream nail polishes are preferable, since frosted polishes generally appear to cause splitting and deterioration of nails, possibly because of the ground fish scales contained therein. In addition, it has also been observed that the application of frosted polish sometimes causes bubbles to occur under the polish because of the slow drying action of the frosted polish.

After the cream nail polish has been dried, a final top coating of a clear polish is then applied. Clear polish, such as those commercially available, may be used and, preferably, should be fast drying. It is also advisable to apply the top coating of clear polish over the nail tips and on the underside of the nails as well.

In order to maintain the nails in the proper condition while the nails are growing, it is preferable that the patron continue treatment in accordance with the present invention until the entire nail has been replaced by a new growth.

It has been observed that fingernails grow at the rate of approximately one-eighth of an inch per month. The strengthening and protective coating of the present invention should, therefore, be applied to the growing nails until such time as the new nail has been completely developed and grows to the desired length. The application of the protein compositions, in accordance with the present invention, is intended to enhance the growth of strong, new, healthy nails.

Accordingly, the patron should be subjected to treatment until the new nails under the protective coatings have grown to the desired length. In order to assure complete coating of the nails as they grow, the patron's nails are recoated periodically, but leaving the old coating on during a second and third visitation. Thus, in accordance with the present invention, the patron should have the coated nails treated subsequently, for example twice within the week of the initial treatment, once the second week after the initial treatment, and preferably twice during the third week. During the second and third visits, the nails are sterilized and cleaned in the vitamin germicide solution above-mentioned; the cuticle lactol treatment again applied with the cuticles then being pushed back in the normal manner and the cream then removed in the vitamin-mineral germicide solution. At this point, any chipping or cracks of the nail are buffed and filled in with the tips or mending strips as described above. The cuticles are then clipped prior to the recoating process. First, the fiber solution is applied directly to the clean nail, on the top and underneath; then, after the fiber coating has been dried, the aforementioned sealer-hardener is applied thereupon and underneath the nail. The sealer-hardener is then dried; and thirdly, the enamel cream polish is applied. In some cases, it may be necessary to apply two coats of enamel. It is noted that the initial coatings are not removed when this second treatment is applied. Finally, the top-sealer coating is applied on the top and underneath the nails.

The fourth treatment usually entails removal of all the coatings with the original process being repeated, as indicated above. It has been observed that the patron may paint the cream enamel polish, or clear polish, over the coatings applied, in accordance with the present invention, without effecting the strengthening and growth of the nails; however, it is noted that, in some cases, where the patron has removed the coatings, according to the present invention, from the nails, the strengthening and growth of the nails does not proceed in accordance with the practice of the present invention.

It is preferable to conclude each visit above enumerated by applying a vitamin E oil around the cuticles and massaging the cuticles and fingers to stimulate the circulation, which is then followed by a cucumber skin cream application to each hand which is then dried.

As a secondary helper it is suggested that an amino acid tablet be taken by mouth, i.e., a protein natural vitamin completely made from milk. This helps to enhance the natural growth of the nails.

In accordance with the aforementioned process, it will be observed that the nails are treated directly with a protein base material.

While there have been disclosed particular embodiments of the present invention, other embodiments will become readily apparent to one skilled in the art and, accordingly, this invention should be considered to be limited in scope only by the accompanying claims.

I claim:

1. A process for enhancing the growth and strength of fingernails and toenails, including the steps of:

coating the nails with a dryable protein containing tacky emulsion comprising a mixture of henna, an aqueous solution of collagen polypeptides and water;

heating the thus coated nails to open the nail pores to absorb the protein mixture;

drying the nails;

coating the thus protein penetrated coated nails with a second cream emulsion coating, preferably at room temperature, including protein and silicone in an amount sufficient to enhance protein dispersion into the nails from both coatings and provide a protective and shinable silicone coating on the nails;

buffing the thus coated nails to increase the moisture and protein content in the nails;

drying the thus treated nails;

coating the nails with a dryable liquid suspension of a fibrous material to minimize breaking of the nails and provide a base for later applied polish; and drying the suspension to adhere the ingredients of the suspension to the second coating.

2. A composition for enhancing the growth and strength of fingernails and toenails comprising a protein containing tacky emulsion of a mixture of an aqueous solution of neutral henna, an aqueous solution of collagen polypeptides, amino acids and water, preferably at room temperature.

3. The process of claim 1 wherein the nails are first cleaned to remove existing polish before applying the tacky emulsion.

4. The process of claim 1 wherein the nails are rinsed after the application of the tacky emulsion to remove excess emulsion.

5. The process of claim 1 wherein the excess second cream emulsion coating is removed from the nails following the buffing of the nails.

6. The method of claim 1 including the step of applying a dryable aqueous solution of a nail sealer to the third mentioned coating, drying the nail sealer solution and then applying a cream nail polish over the dried sealer.

7. The method of claim 6 including the step of applying an outer clear coat of enamel on said polish after drying of the polish.

8. Process for enhancing the growth and strength of fingernails and toenails, including the steps of:

cleaning the nails and removing existing polish;

coating the thus cleaned nails with a dryable protein containing tacky emulsion comprising a mixture of an aqueous solution of henna, an aqueous solution of collagen polypeptides, amino acids and water, preferably at room temperature;

heating the thus coated nails to open the nail pores to absorb the protein mixture;

rinsing the nails to remove excess emulsion;

drying the emulsion remaining on the nails;

coating the thus protein penetrated coated nails with a second cream emulsion coating, preferably at room temperature, including protein and silicane in an amount sufficient to enhance protein dispersion into the nails from both coatings and provide a protective and shinable silicone coating on the nails;

buffing the nails to increase the moisture and protein content in the nails;

removing the excess of the second coating from the nails;

drying the thus treated nails;

coating the nails with a dryable liquid suspension of a fibrous material to minimize breaking of the nails and provide a base for the later applied polish;

drying the suspension to adhere the ingredients of the suspension to the second coating;

applying a dryable aqueous solution of a nail sealer to said dried suspension to seal the suspension;

drying the solution;

applying a compatible cream enamel nail polish to the dried solution;

drying the polish; and applying an outer clear coat of enamel on said polish.

9. The method of claim 1 wherein the proteinaceous material is buffed into the nails.

* * * * *

UNITED STATES PATENT AND TRADEMARK OFFICE

CERTIFICATE OF CORRECTION

PATENT NO. : 4,267,852

DATED : May 19, 1981

INVENTOR(S) : JUDITH E. HULLINGER

It is certified that error appears in the above-identified patent and that said Letters Patent are hereby corrected as shown below:

Claim 8, Column 6, Line 29, change "silica" to --silicone--.

Signed and Sealed this

*First* Day of *September 1981*

[SEAL]

*Attest:*

GERALD J. MOSSINGHOFF

*Attesting Officer*

*Commissioner of Patents and Trademarks*